US006755055B2

(12) United States Patent
Sedon et al.

(10) Patent No.: US 6,755,055 B2
(45) Date of Patent: Jun. 29, 2004

(54) THEFT DETERRENT DEVICE

(75) Inventors: Nicholas M. Sedon, Massillon, OH (US); Frank H. Copen, Shreve, OH (US)

(73) Assignee: Alpha Security Products, Inc., Canton, OH (US)

( * ) Notice: Subject to any disclaimer, the term of this patent is extended or adjusted under 35 U.S.C. 154(b) by 143 days.

(21) Appl. No.: 10/085,795

(22) Filed: Feb. 26, 2002

(65) Prior Publication Data

US 2003/0160697 A1 Aug. 28, 2003

(51) Int. Cl.[7] ..... E05B 65/00

(52) U.S. Cl. ..... 70/57.1; 70/49; 70/58; 292/319

(58) Field of Search ..... 24/704.1, 18, 704.2; 70/18, 57.1, 58, 30, 49, 50, 233; 340/572.9, 572.8, 571; 292/307 R, 319, 318, 317

(56) References Cited

U.S. PATENT DOCUMENTS

| | | | | |
|---|---|---|---|---|
| 199,468 A | | 1/1878 | Rheubottom | |
| 596,237 A | | 12/1897 | Damon | |
| 639,196 A | | 12/1899 | Fehling | |
| 673,612 A | | 5/1901 | Appleby | |
| 886,905 A | | 5/1908 | Ward | |
| 895,403 A | | 8/1908 | Jackson | |
| 1,012,882 A | * | 12/1911 | Austin et al. | 292/318 |
| 1,083,612 A | | 1/1914 | Hooker | |
| 1,124,130 A | | 1/1915 | Grant | |
| 1,141,245 A | | 6/1915 | Gillespie | |
| 1,165,320 A | | 12/1915 | Clary | |
| 1,165,816 A | | 12/1915 | Tichenor | |
| 1,601,493 A | | 9/1926 | Condon | |
| 1,657,190 A | | 1/1928 | Ballou | |
| 2,002,946 A | | 5/1935 | Jacobs | |
| 3,214,808 A | | 11/1965 | Litwin | |
| 3,395,555 A | | 8/1968 | Hickman | |
| 3,466,668 A | | 9/1969 | Ochiai | |
| 3,611,760 A | | 10/1971 | Muther | |
| 3,636,739 A | | 1/1972 | Smedley | |
| 3,754,420 A | | 8/1973 | Oellerich | |
| 3,831,407 A | | 8/1974 | Coleman | |
| 3,872,547 A | | 3/1975 | Caveney et al. | |
| 3,906,758 A | | 9/1975 | Hurwitt | |
| 4,070,879 A | * | 1/1978 | Thompson | 70/20 |
| 4,071,023 A | | 1/1978 | Gregory | |
| 4,086,795 A | | 5/1978 | Foster et al. | |
| 4,128,220 A | | 12/1978 | McNeel | |
| 4,191,334 A | | 3/1980 | Bulanda et al. | |
| 4,196,424 A | | 4/1980 | Williamson | |
| 4,287,644 A | | 9/1981 | Durand | |
| 4,299,870 A | | 11/1981 | Humble | |
| 4,418,551 A | | 12/1983 | Kochackis | |
| 4,499,680 A | | 2/1985 | Coburn | |
| 4,506,415 A | | 3/1985 | Swift | |
| 4,580,319 A | | 4/1986 | Paradis | |

(List continued on next page.)

FOREIGN PATENT DOCUMENTS

| | | |
|---|---|---|
| DE | 123470 | 11/1948 |
| DE | 27 25 580 A1 | 12/1977 |

*Primary Examiner*—John B. Walsh
(74) *Attorney, Agent, or Firm*—Sand & Sebolt

(57) ABSTRACT

A theft deterrent device includes a base, a plug, and a cable assembly that is selectively connected to the base and the plug. The plug may be locked to the base to form a closed loop that may be used to hold merchandise. In situations where the plug cannot be threaded through the merchandise, the cable assembly may be disconnected from the plug to provide a smaller cross-section so that it may be threaded through the merchandise. The cable assembly is then reconnected to the plug so that the loop may be locked. The cable assembly is also replaceable so that the user does not have to discard the entire device if the cable is cut.

27 Claims, 8 Drawing Sheets

U.S. PATENT DOCUMENTS 4,631,782 A 12/1986 Gecs
4,708,306 A 11/1987 Mitomi
4,736,604 A * 4/1988 Zeller et al. ..... 70/457
4,756,171 A 7/1988 Homar
4,813,105 A 3/1989 Espinoza
4,823,442 A 4/1989 Behr
4,825,156 A 4/1989 Read
4,833,807 A 5/1989 McLean
4,896,517 A 1/1990 Ling
4,897,899 A 2/1990 Shely et al.
4,919,373 A 4/1990 Caveney et al.
4,929,006 A * 5/1990 Tsay ..... 292/324
4,930,324 A 6/1990 Meier
4,944,475 A 7/1990 Ono et al.
4,949,679 A 8/1990 Wolfer
4,958,414 A 9/1990 Benoit
4,962,369 A 10/1990 Close
5,042,114 A 8/1991 Parrish
5,079,540 A 1/1992 Narlow et al.
5,119,652 A 6/1992 Costa
5,121,524 A 6/1992 Mortensen
5,123,686 A 6/1992 Wenk
5,144,820 A 9/1992 Holmgren
5,144,821 A 9/1992 Ernesti et al.
5,156,028 A 10/1992 Jiang
5,193,368 A 3/1993 Ling
5,230,541 A 7/1993 Nowak
5,279,136 A 1/1994 Perry
5,293,668 A * 3/1994 Tibiletti ..... 24/16 PB
5,337,503 A 8/1994 Goby
5,345,947 A 9/1994 Fisher
5,377,388 A 1/1995 DeBever
5,379,496 A 1/1995 Krauss
5,421,177 A * 6/1995 Sieber et al. ..... 70/57.1
5,431,393 A * 7/1995 Wang ..... 473/596
5,437,172 A 8/1995 Lamy et al.
5,440,904 A 8/1995 Su
5,517,835 A 5/1996 Smith
5,517,836 A 5/1996 Hong
5,524,463 A 6/1996 Schenkel et al.
5,551,447 A 9/1996 Hoffman et al.
5,568,951 A 10/1996 Morgan
5,581,853 A 12/1996 Miller et al.
5,627,520 A 5/1997 Grubbs et al.
5,671,506 A 9/1997 Eliasson
5,687,455 A 11/1997 Alexander
5,687,456 A 11/1997 Chang
5,722,266 A 3/1998 Yeager et al.
5,794,464 A 8/1998 Yeager et al.
5,850,752 A * 12/1998 Lax ..... 70/276
5,856,782 A * 1/1999 Sasagawa et al. ..... 340/572.9
5,864,290 A * 1/1999 Toyomi et al. ..... 340/572.9
5,951,047 A * 9/1999 Dungan ..... 280/814
5,969,613 A 10/1999 Yeager et al.
6,052,876 A * 4/2000 Hogan et al. ..... 24/704.1
6,092,401 A * 7/2000 Sankey et al. ..... 70/18
6,128,932 A * 10/2000 Mainetti et al. ..... 70/57.1
6,227,016 B1 * 5/2001 Yu ..... 70/30
6,363,758 B1 * 4/2002 Ling ..... 70/30
6,422,387 B1 * 7/2002 Sedon et al. ..... 206/387.11
6,523,228 B1 * 2/2003 Benoit ..... 24/16 PB

* cited by examiner

THEFT DETERRENT DEVICE

BACKGROUND OF THE INVENTION

1. Technical Field

The present invention generally relates to theft deterrent devices for retail establishments and, more particularly, to an EAS tag-carrying device that may be secured to an item of merchandise. Specifically, the present invention relates to a theft deterrent device having a cable that is used to connect the device to an item of merchandise; the cable having a small head that allows it to be threaded through small openings on an item of merchandise while also being selectively connected to a plug that includes one of the portions of the lock mechanism.

2. Background Information

Various retail establishments use theft deterrent systems to discourage shoplifting. A common theft deterrent system uses electronic article surveillance (EAS) tags attached to items of merchandise. The EAS tags are configured to activate an alarm that is positioned at the exit of the establishment.

Securing the EAS tags to merchandise is a problem faced by most retail establishments. The tags must be connected in a secure manner that prevents unauthorized removal while not damaging the items of merchandise. The tags must also be readily removable by authorized personnel so that the tags do not unduly delay checkout.

The prior art is replete with EAS tag carriers designed to secure EAS tags to merchandise. Various types are known in the art such as frames that extend around items, pins that pierce items, and cables that wrap around items. The present invention relates to the types of devices that use cables to wrap around a portion of the merchandise. A problem with these types of devices is that the leading end of the cable is often too large to fit through the openings on the merchandise where the retail establishment wishes to secure the device. Another problem is that the devices must be discarded if the cable portion of the device is broken by the shoplifter. A further problem is that the devices are not always easy to unlock. The invention described in this application addresses these issues.

BRIEF SUMMARY OF THE INVENTION

The invention provides a theft deterrent device that includes a base, a plug, and a cable that is selectively connected to the base and the plug. The plug may be locked to the base to form a closed loop that may be used to hold merchandise. In situations where the plug cannot be threaded through the merchandise, the cable assembly may be disconnected from the plug to provide a smaller cross-section so that it may be threaded through the merchandise. The cable assembly is then reconnected to the plug so that the loop may be locked. The cable assembly is also replaceable so that the user does not have to discard the entire device if the cable is cut.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
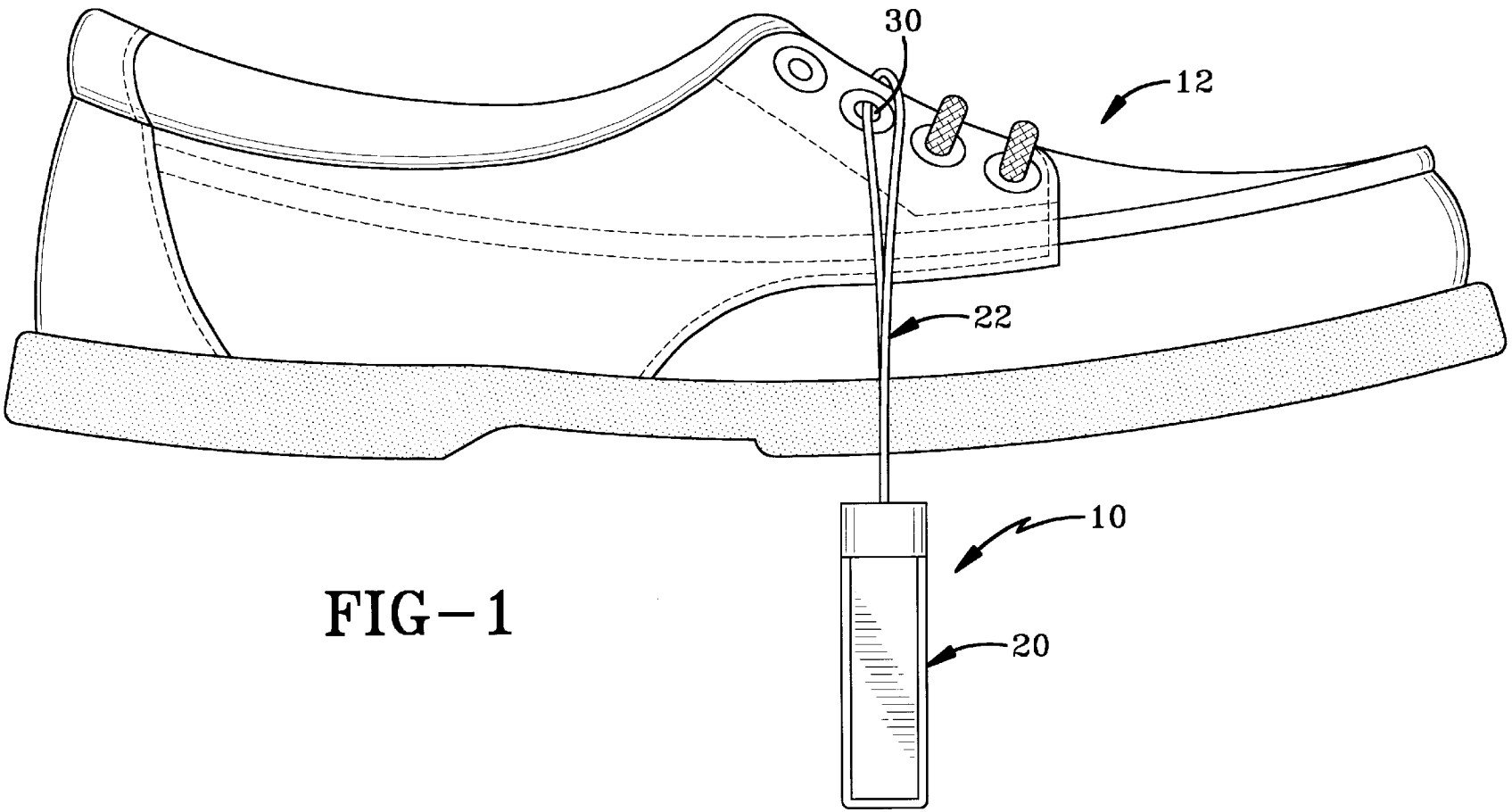
FIG. 1 is an elevation view showing the device of the present invention attached to an item of merchandise.
Figure 2:
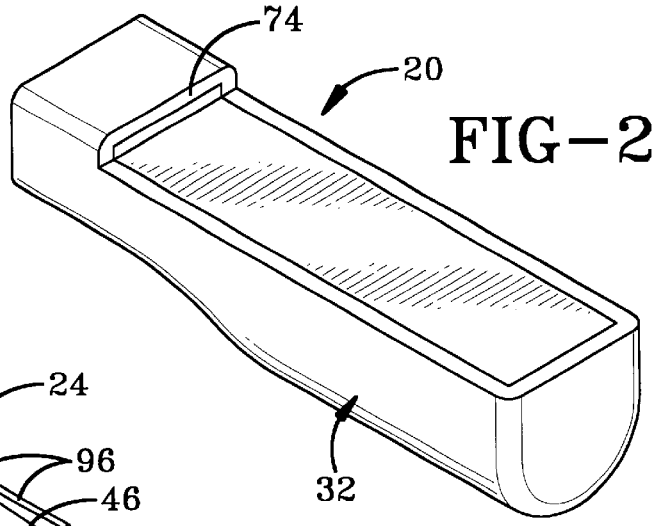
FIG. 2 is a perspective view of the base of the device.
Figure 3:
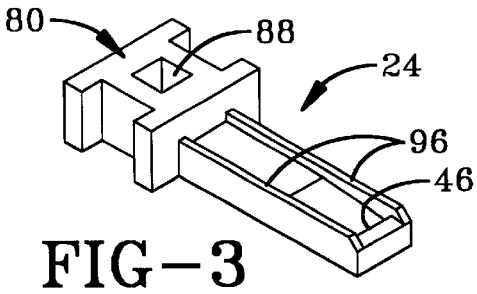
FIG. 3 is a perspective view of the plug of the device.
Figure 4:
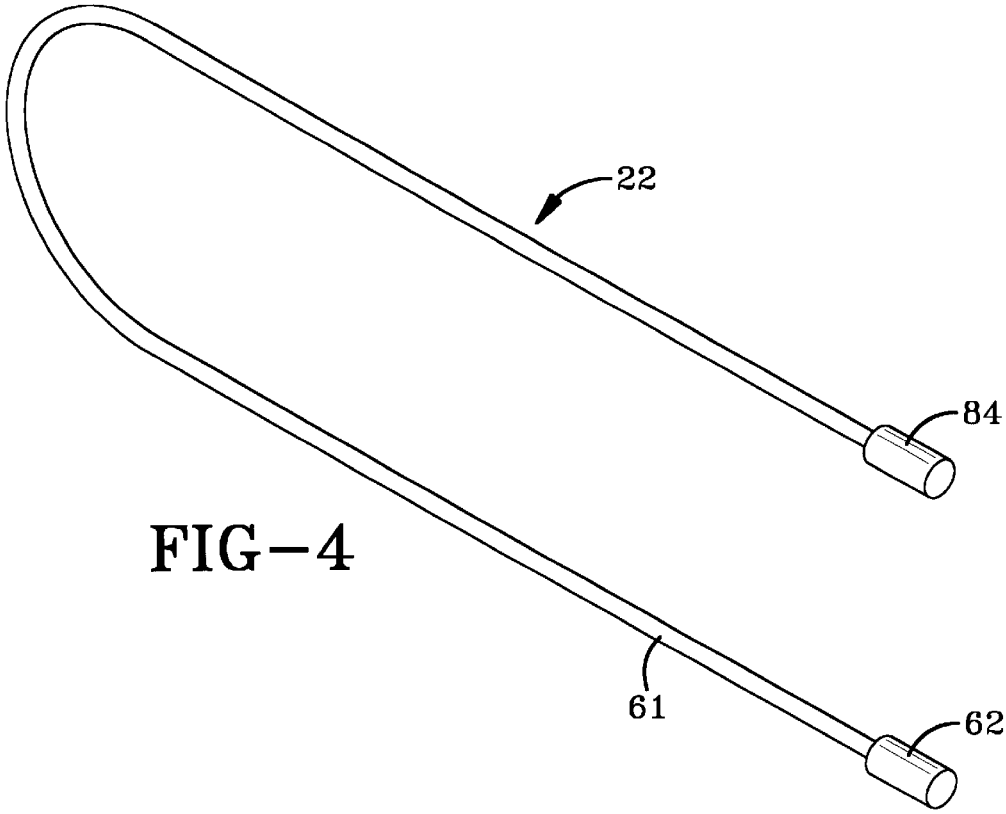
FIG. 4 is a perspective view of the cable of the device.
Figure 5:
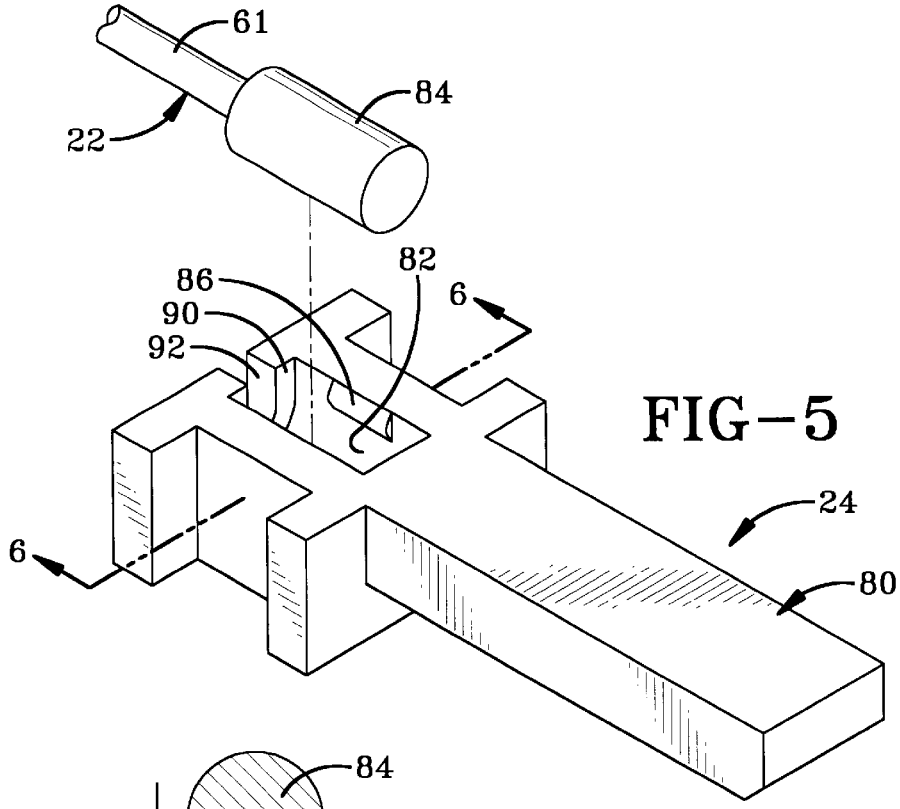
FIG. 5 is a perspective view showing the end of the cable being inserted into the plug.
Figure 6:
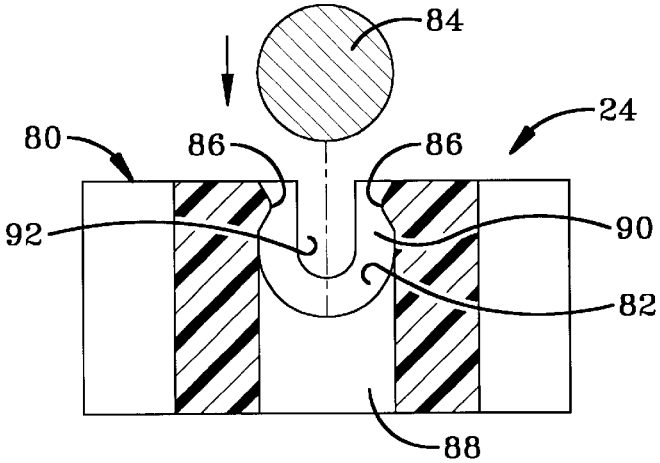
FIG. 6 is a section view taken along line 6—6 of FIG. 5.
Figure 7:
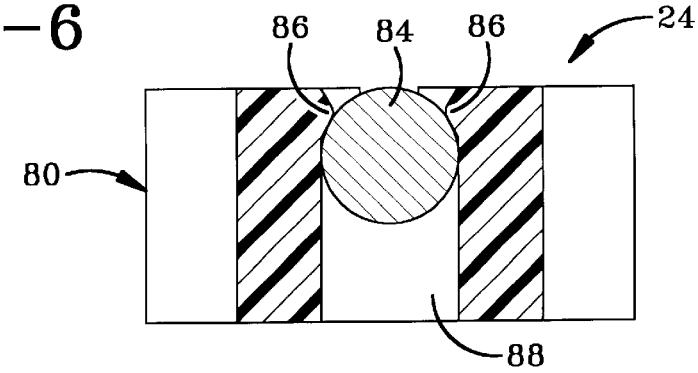
FIG. 7 is a view similar to FIG. 6 showing the end of the cable fully inserted into the plug.
Figure 8:
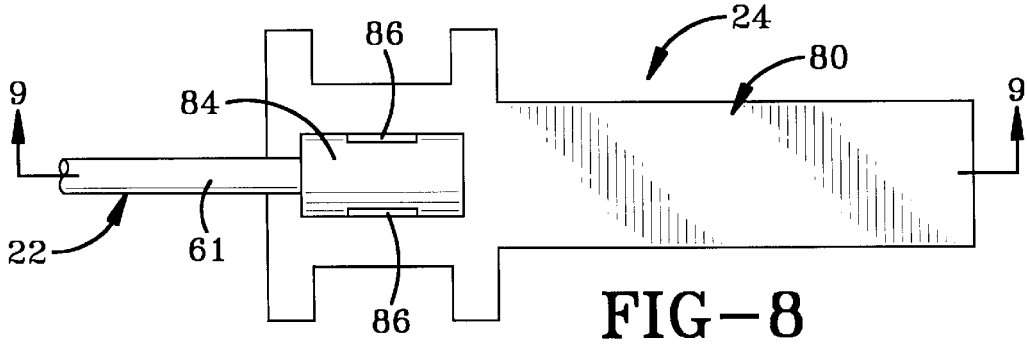
FIG. 8 is a top plan view of the plug with the end of the cable inserted into the plug.
Figure 9:
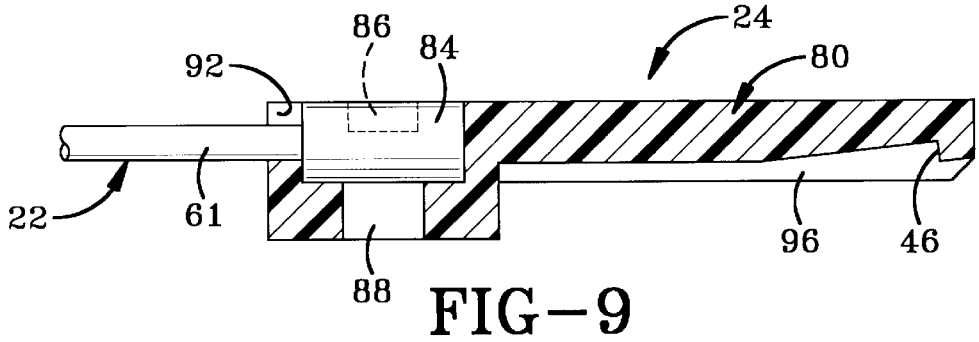
FIG. 9 is a section view taken along line 9—9 of FIG. 8.
Figure 10:
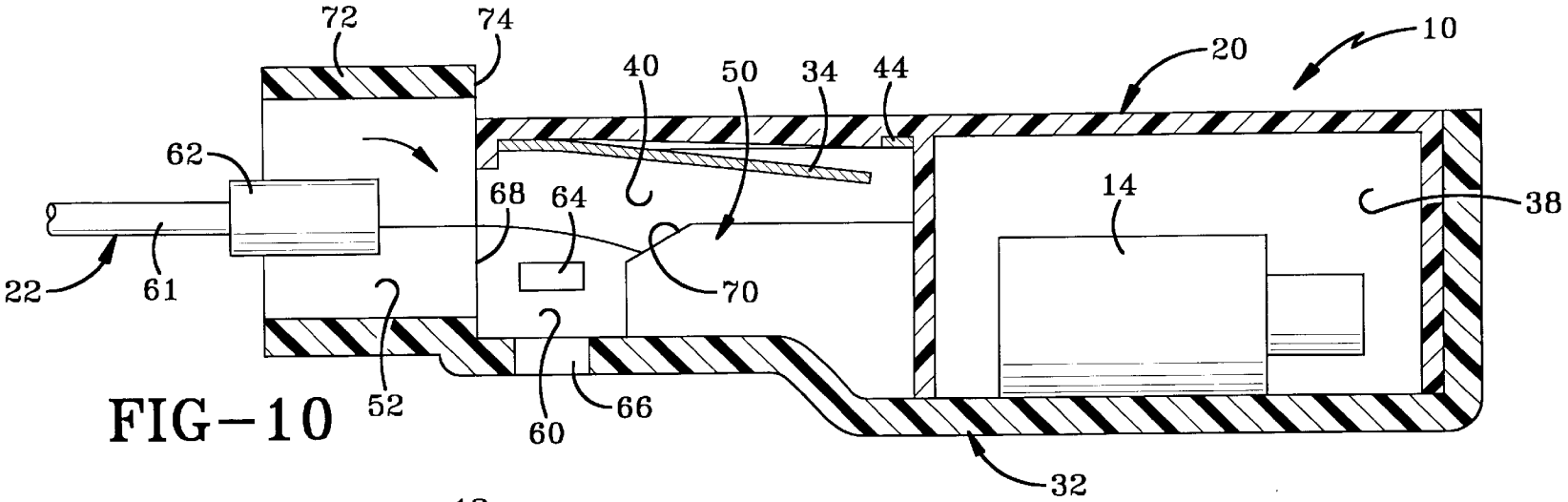
FIG. 10 is a longitudinal section view taken through the base showing the end of the cable being inserted into the base.
Figure 11:
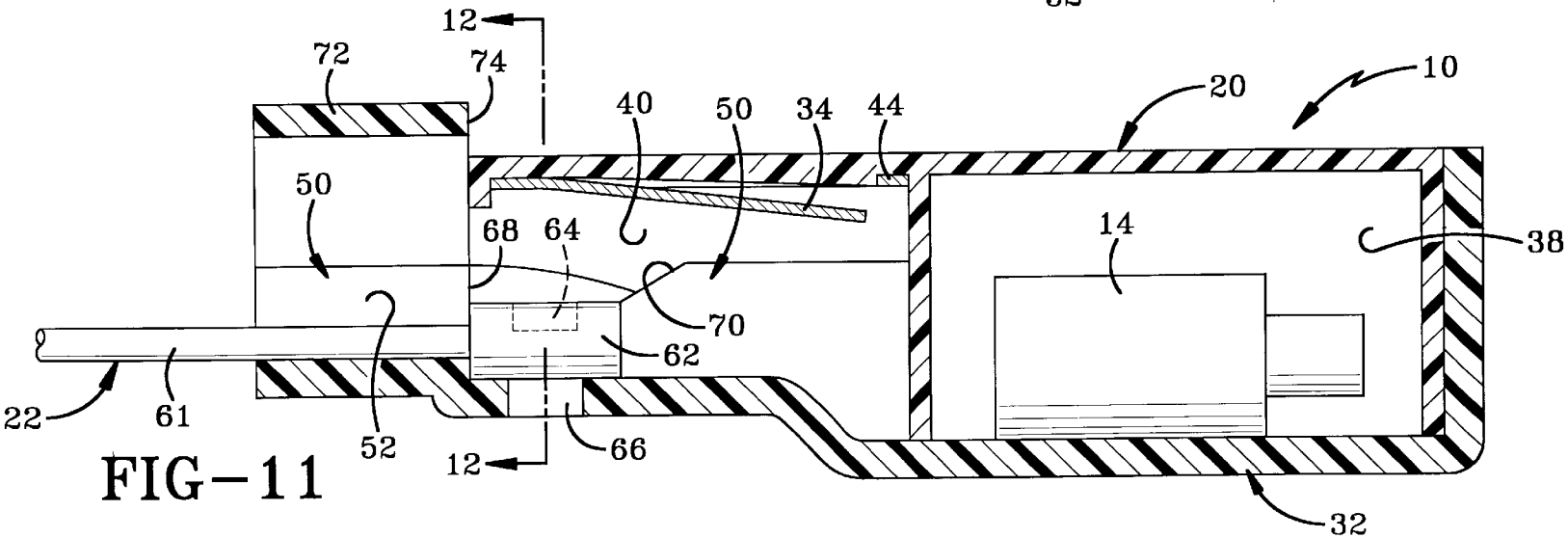
FIG. 11 is a view similar to FIG. 10 showing the end of the cable fully inserted into the base.
Figure 13:
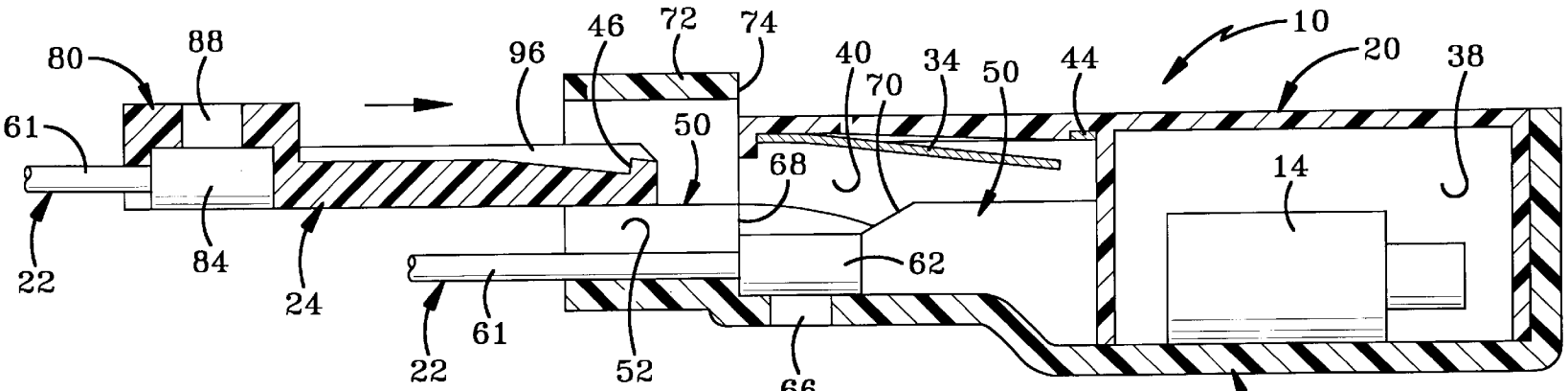
FIG. 13 is a view similar to FIG. 10 showing the plug being inserted into the base.

The theft deterrent device of the present invention is indicated generally by the numeral 10 in the accompanying drawings. Device 10 is configured to be securely attached to an item of merchandise 12 (such as the shoe shown in the exemplary embodiment of FIG. 1) to deter a shoplifter from steeling merchandise 12. Device 10 may be used with an EAS tag 14 as shown in FIG. 10. Device 10 may also be used without tag 14 simply to provide a visual deterrent to shoplifting.

Device 10 generally includes a base 20, a cable assembly 22, and a plug 24. Cable assembly 22 is configured to be selectively attachable to both base 20 and plug 24. In the context of this application, the word "selectively" is defined as meaning that something may be repeatedly made and unmade. The phrase "selectively attachable" or "selectively connectable" is understood to be a connection that can be repeatedly made and unmade. As such, cable 22 is selectively attachable to base 20 so that the user may disconnect cable assembly 22 from base 20 as needed and then may reconnect cable assembly 22 with base 20 when necessary. This distinguishes prior art references wherein cables are permanently attached with welds, press fits, and other similar connections that prevent repeated removal and reattachment.

In general, device 10 is connected to item 12 by threading cable assembly 22 through an opening 30 defined by item 12. In some situations, opening 30 is rather small such as the eyelet on the shoe depicted in FIG. 1. In these situations, plug 24 cannot fit through opening 30 and device 10 would not be able to be used with item 12 unless it could be connected to another portion of item 12. In accordance with one of the objects of the present invention, plug 24 may be separated from cable assembly 22 so that cable assembly 22 may be threaded through opening 30. Plug 24 is then locked to base 20 to securely connect device 10 to item 12. Tag 14 is thus secured to item 12.

Figure 14:
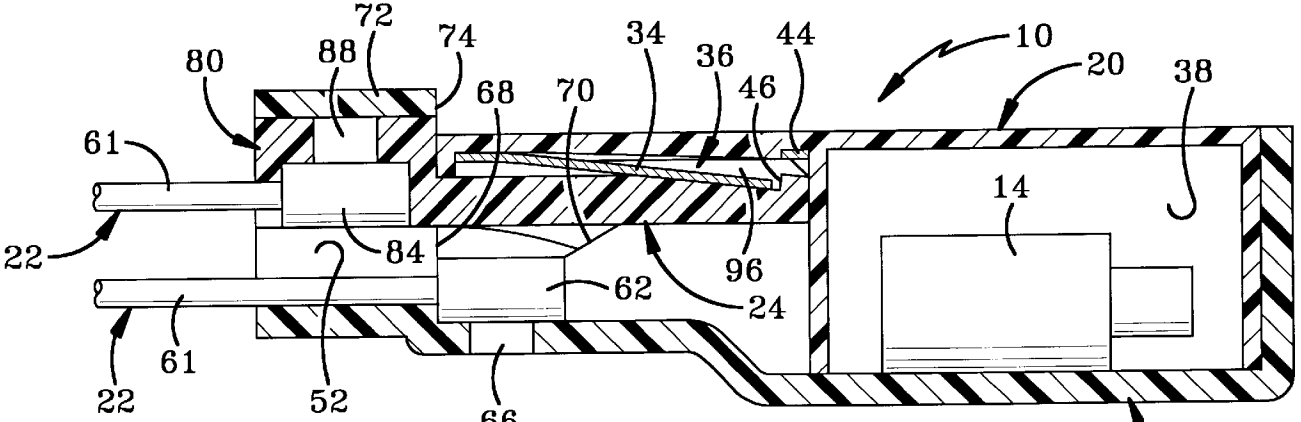
FIG. 14 is a view similar to FIG. 13 showing the plug fully inserted into the base.
Figure 15:
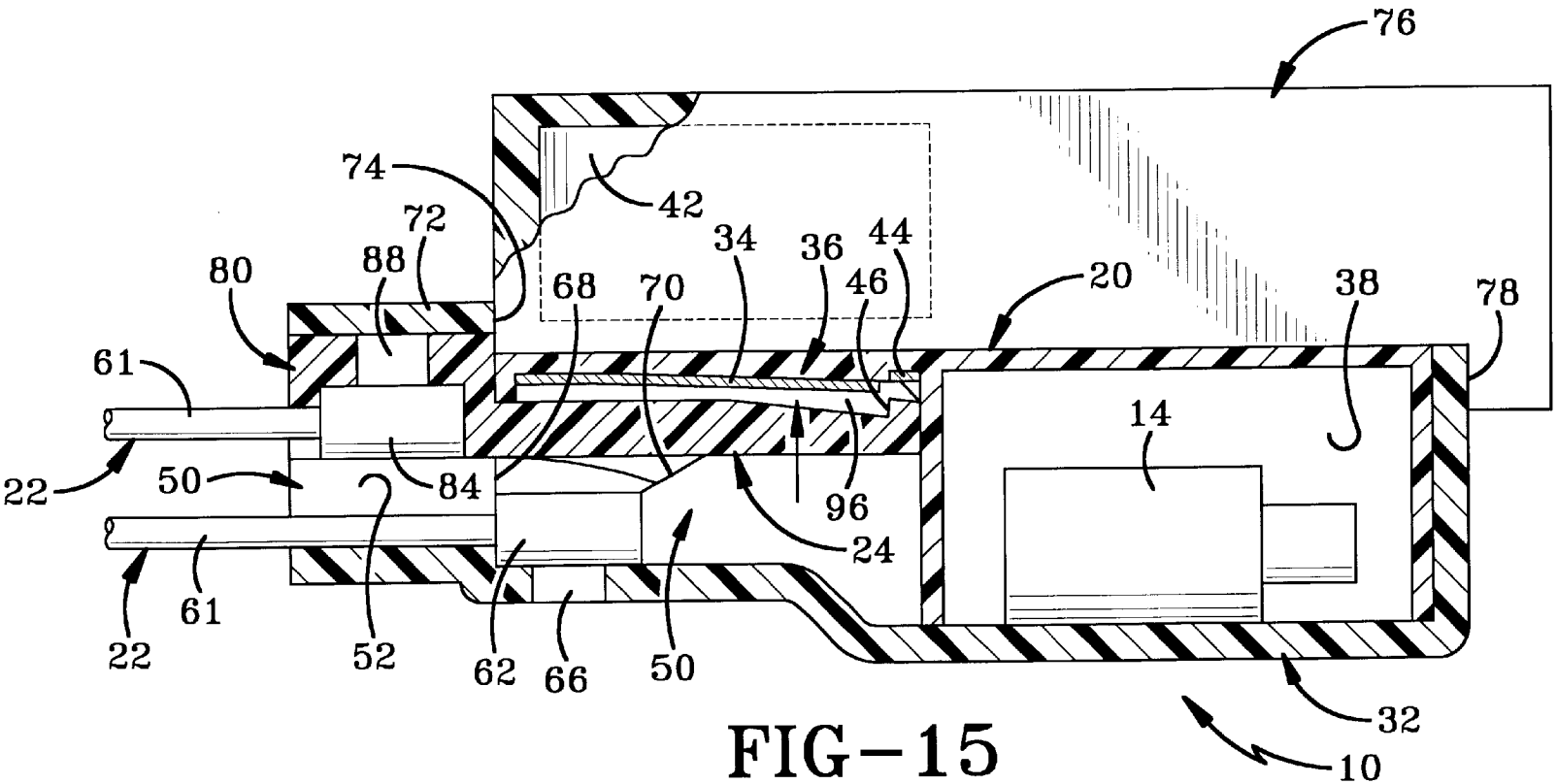
FIG. 15 is a section view showing the device being unlocked with an opener.

Base 20 generally includes a body 32 and a first portion 24 of a lock mechanism 36. Body 32 may define a recess or a closed chamber 38 configured to hold tag 14. The type of tag 14 may define the size and shape of chamber 38. Body 32 also defines a port 40 configured to selectively receive plug 24 and a portion of cable assembly 22. First portion 34 of lock mechanism 36 is carried by body 32 such that it is exposed to port 40. In the exemplary embodiment, first portion 34 is a resilient lock finger that moves between locking (FIG. 14) and unlocking (FIG. 15) positions. In the exemplary embodiment, the lock finger is fabricated from a magnetically attractable material (such as spring steel) such that the finger may be moved from the locking position to the unlocking position with a magnet 42 as shown in FIG. 15. The finger automatically moves back to the locking position because of its resilient nature. The finger may project from a frame 44 that is held by body 32 in a secure manner such as being sandwiched between opposed walls (shown in FIG. 12). Frame 44 may also be snap-fit into body 32 if desired.

The second portion 46 of lock mechanism 36 is formed on plug 24 and includes a ledge that cooperates with the lock finger to lock plug 24 to body 20. In another embodiment of the invention, the positions of first and second lock members 34 and 46 may be switched so that the lock finger is carried by plug 34 and the ledge is defined by body 32.

Figure 12:
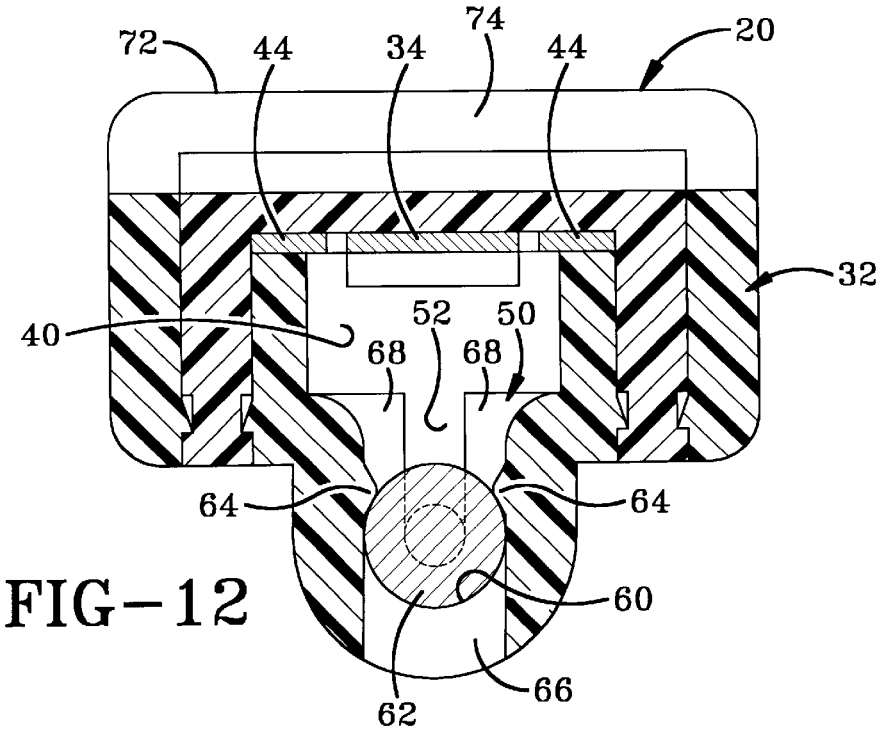
FIG. 12 is a section view taken along line 12—12 of FIG. 11.

Body 32 includes a plug support wall 50 that supports the bottom of plug 24 when plug 24 is disposed in port 40. Support wall 50 includes forward, intermediate, and rear portions. As shown in FIG. 12, the forward portion of wall 50 is split by a channel 52 that allows a portion of cable assembly 22 to be received between the two split portions of wall 50. An intermediate portion of wall 50 defines a first recess 50 that is configured to selectively receive a first barrel 62 connected to a first end of cable 61. Wall 50 may include bosses 64 that function as dual ramps to allow barrel 62 to be snapped into and out of recess 60. Wall 50 may also define an access opening 66 that allows the user to push barrel 62 out of recess 60 when desired.

Barrel 62 may thus be inserted into port 40 and pressed down into recess 60 to selectively secure cable assembly 22 to base 20. The user may disconnect cable assembly 22 from base 20 by inserting a suitable pusher into access opening 66 to push barrel 62 back through bosses 64. Bosses 64 and the walls of body 32 are suitably flexible and resilient to allow for repeated installation and removal of barrel 62.

FIG. 12 also depicts stopping wall 68 that prevents barrel 62 from being out of channel 52. Wall 50 also includes an angled portion 70 that prevents plug 24 from catching on wall 50 when it is inserted into base 20.

Figure 16:
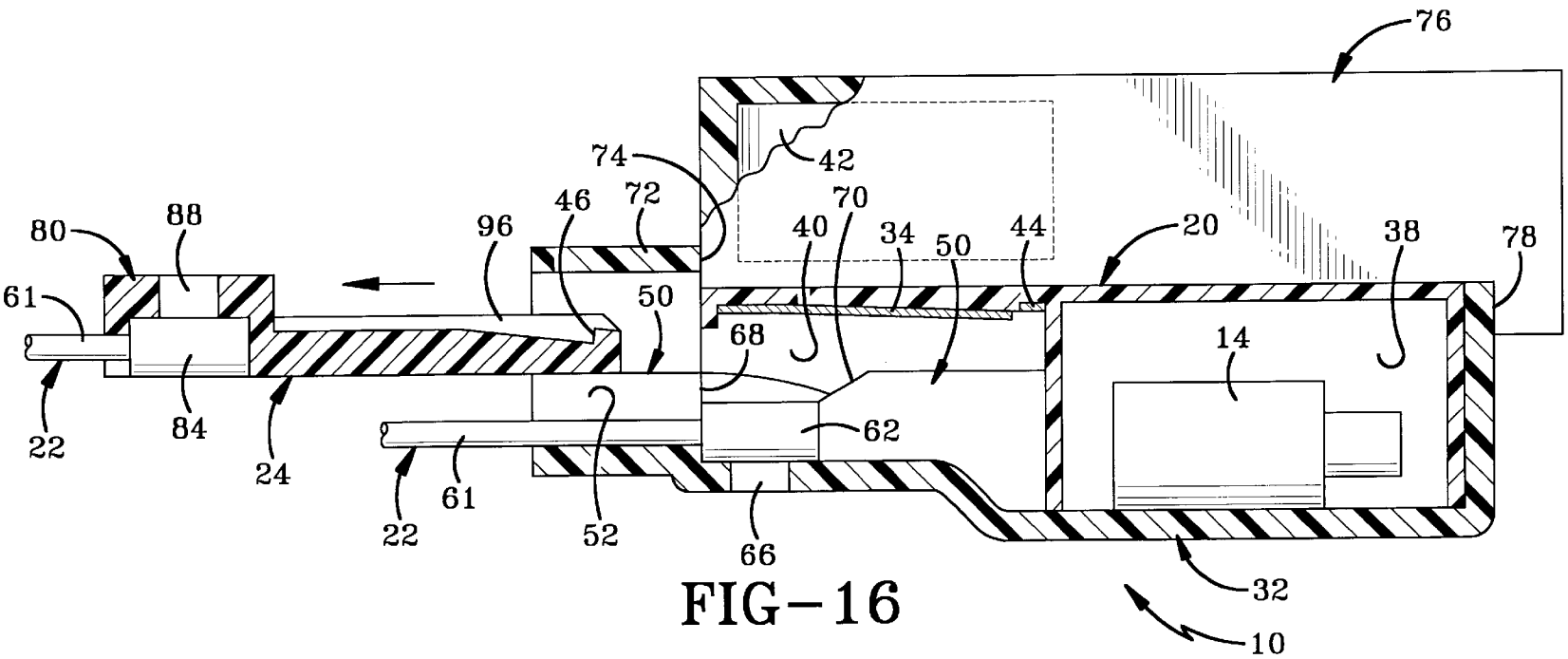
FIG. 16 is a view of the device in the unlocked position showing the plug being removed.

Body 32 also includes a top wall 72 that defines a portion of port 40. Wall 72 is raised from the wall that holds portion 34 to form a step 74. Step 74 may be used to properly position a key 76 as shown in FIGS. 15 and 16 so that magnet 42 is properly aligned with lock portion 34. Key 76 may define its own step 78 to help position device 10.

Turning now to plug 24 that is selectively received in base 20, we find that plug 24 has a body 80 having a forward portion and a rear portion. The rear portion of body 80 defines a recess 82 configured to selectively receive a second barrel 84 that is secured to the second end of cable 61. Bosses 86 similar to those described above are provided on body 80 where they projected out into recess 82 to selectively hold barrel 84. Body 80 also defines an access opening 88 that allows the user to push barrel 84 out of body 80.

The rear wall 90 of body 80 defines a slot 92 that receives cable 61 when barrel 84 is snapped into recess 82. Rear wall 90 prevents barrel 84 from being pulled out of plug 24.

The forward portion of body 80 defines the second portion of lock mechanism 36. Second portion 46 of lock mechanism 36 includes a ledge as described above and the ledge is defined by the forward portion of body 80. Ledge 46 is engaged by lock finger 34 when lock mechanism 36 is in the locked position. Forward portion of body 80 also defines sidewalls 96 that are disposed on the sides of lock fingers 34 when lock mechanism 36 is in the locked position. Walls 96 thus provide lateral support to finger 34 when lock mechanism 36 is locked.

Device 10 may be used by snapping barrel 62 into base 20 so that cable assembly 22 is secure to base 20. The user may then loop barrel 84 through opening 30. Barrel 84 is then snapped into plug 24. Plug 24 is then inserted into base 20 until lock mechanism 36 moves to the locked position. In this position, barrels 82 and 84 are trapped in place and cannot be removed without destroying a portion of device 10. The device may also be used without disconnecting barrel 84 from plug 24 when opening 30 is large enough to accept plug 24. Device 10 thus provides a adaptable theft deterrent device that may be used with different items of merchandise 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A theft deterrent device for use with an item of merchandise, the device comprising:

a base;

a plug selectively connectable to the base;

a cable having a first end and a second end; the first end of the cable being connected to the base; the second end of the cable being selectively connectable to the plug;

the cable having a cross sectional size and the plug having a cross sectional size; the cross sectional size of the cable being smaller than the cross sectional size of the plug;

the second end of the cable being removable from plug when the plug is not connected to the base; and the second end of the cable is trapped to the plug when the plug is connected to the base.

2. The device of claim 1, further comprising an EAS tag carried by the base.

3. The device of claim 1, further comprising a lock mechanism movable between locked and unlocked positions; the lock mechanism configured to lock the plug to the base when the plug is connected to the base.

4. The device of claim 3, wherein the lock mechanism is movable from the locked position to the unlocked position by magnetic force.

5. The device of claim 4, wherein the lock mechanism includes a lock finger and a ledge; the lock finger being carried by one of the plug and the base; the ledge being defined by the other of the plug and the base; the lock finger engaging the ledge when the lock mechanism is in the locked position.

6. The device of claim 1, wherein the cable is selectively connected to the base.

7. The device of claim 6, wherein the base defines a recess; the cable being snapped into the recess when the cable is connected to the base.

8. The device of claim 7, wherein the cable includes a barrel; the base including opposed bosses projecting into the recess; the barrel being snap fit under the bosses to connect the cable to the base.

9. The device of claim 8, wherein the base defines an access opening that allows the barrel to be pushed out of the recess.

10. The device of claim 7, wherein the plug covers the recess to trap the cable within the base when the plug is connected to the base.

11. The device of claim 1, wherein the plug defines a recess; the cable being snapped into the recess to connect the able with the plug.

12. A theft deterrent device for use with an item of merchandise, the device comprising:

a base;

a plug selectively connectable to the base;

a cable having a first end and a second end; the first end of the cable being connected to the base; the second end of the cable being selectively connectable to the plug;

the cable having a cross sectional size and the plug having a cross sectional size; the cross sectional size of the cable being smaller than the cross sectional size of the plug;

the plug defining a recess; the cable being snapped into the recess to connect the cable with the plug; and the cable including a barrel; the plug including opposed bosses projecting into the recess; the barrel being snap fit under the bosses to connect the cable to the plug.

13. The device of claim 12, wherein the plug defines an access opening that allows the barrel to be pushed out of the recess.

14. The device of claim 12, wherein the recess to of the plug is blocked by the base to trap the cable within the plug when the plug is connected to the base.

15. A theft deterrent device for use with an item of merchandise, the device comprising:

a base;

a plug selectively connectable to the base;

a cable having a first end and a second end;

a first barrel connected to the first end of the cable;

a second barrel connected to the second end of the cable;

the first barrel being selectively connectable to the base to selectively connect the cable to the base;

the second barrel being selectively connectable to the plug to selectively connect the cable to the plug;

a lock mechanism movable between locked and unlocked positions; the lock mechanism configured to lock the plug to the base when the plug is connected to the base;

an EAS tag carried by the base; and the cable having a cross sectional size and the plug having a cross sectional size; the cross sectional size of the cable being smaller than the cross sectional size of the plug.

16. A theft deterrent device for use with an item of merchandise, the device comprising:

a base;

a plug selectively connectable to the base;

a cable having a first end and a second end;

a first barrel connected to the first end to the cable;

a second barrel connected to the second end of the cable;

the first barrel being selectively connectable to the base to selectively connect the cable to the base;

the base defines a recess;

the base including opposed bosses projecting into the recess; the first barrel being snap fit under the bosses to connect the cable to the base;

the second barrel being selectively connectable to the plug to selectively connect the cable to the plug;

the plug defines a recess;

the plug including opposed bosses projecting into the recess; the second barrel being snap fit under the bosses to connect the cable to the plug;

a lock mechanism movable between bc ed and unlocked positions; the lock mechanism configured to lock the plug to the tease when the plug is connected to the base;

an EAS tag carried by the base; and the cable having a cross sectional size and the plug having a cross sectional size; the cross sectional size of the cable being smaller than the cross sectional size of the plug.

17. The device of claim 16, wherein the base defines an access opening that allows the barrel to be pushed out of the recess.

18. The device of claim 17, wherein the plug defines an access opening that allows the barrel to be pushed out of the recess.

19. The device of claim 16, wherein the lock mechanism is movable from the locked position to the unlocked position by magnetic force.

20. The device of claim 16, wherein the plug locks the first barrel to the base when the plug is locked to the base.

21. The device of claim 15, wherein the lock mechanism is movable from the locked position to the unlocked position by magnetic force.

22. The device of claim 15, wherein the plug locks the first barrel to the base when the plug is locked to the base.

23. The device of claim 12, wherein the plug locks the first end of the cable to the base when the plug is locked to the base.

24. A theft deterrent device for use with an item of merchandise, the device comprising:

a base;

a plug selectively connectable to the base;

a cable having a first end and a second end; the first end of the cable being connected to the base; the second end of the cable being selectively connectable to the plug;

the cable having a cross sectional size and the plug having a cross sectional size; the cross sectional size of the cable being smaller than the cross sectional size of the plug;

a lock movable between locked and unlocked positions; the lock configured to lock the plug to the base when the plug is connected to the base and the lock is in the locked position; the lock allowing the plug to be detached from the base when the lock is in the unlocked position; and the second end of the cable is removable from the plug when the plug is detached from the base and wherein the second end of the cable may not be removed from the plug when the plug is locked to the base.

25. The device of claim 24, wherein the lock must be unlocked with a key.

26. The device of claim 25, wherein the key uses magnetic force to unlock the lock.

27. The device of claim 25, wherein the first end of the cable is removable from the base when the plug is detached from the base and wherein the first end of the cable may not be removed from the base when the plug is connected to the base.

* * * * *